United States Patent [19]

Rowe

[11] Patent Number: 4,807,754

[45] Date of Patent: Feb. 28, 1989

[54] PACKAGING SYSTEM FOR PLASTIC BAGS

[75] Inventor: E. R. Rowe, Hartsville, S.C.

[73] Assignee: Sonoco Products Company, Hartsville, S.C.

[21] Appl. No.: 161,821

[22] Filed: Feb. 29, 1988

[51] Int. Cl.[4] ..... B65D 33/10

[52] U.S. Cl. ..... 206/390; 383/8; 493/194; 493/199; 493/232; 493/926

[58] Field of Search ..... 206/390; 383/8; 493/194, 195, 196, 198, 200, 201, 199, 232, 926

[56] References Cited

U.S. PATENT DOCUMENTS

| | | | |
|---|---|---|---|
| 4,165,832 | 8/1979 | Kuklies et al. . | |
| 4,529,090 | 7/1985 | Pilon | 383/8 X |
| 4,588,392 | 5/1986 | Maddock | 383/8 X |
| 4,744,200 | 5/1988 | Benoit, Jr. et al. | 383/8 X |
| 4,747,815 | 5/1988 | Benoit et al. | 206/390 X |

FOREIGN PATENT DOCUMENTS

| | | | |
|---|---|---|---|
| 79465 | 1/1982 | Australia | 383/8 |

*Primary Examiner*—William Price

*Attorney, Agent, or Firm*—Dennison, Meserole, Pollack & Scheiner

[57] ABSTRACT

A bag package forming system including a continuous strip of multiple serverable T-shirt or handle bags wherein the mouth defined between the laterally spaced handles of each bag includes a pair of overlying foldable lips formed as integral extensions of the overlying sheets of the bag. The lips are of a height of fold over the mouth of the associated bag and define a closure for the mouth to preclude the entry of air thereto and the ballooning of the bag.

8 Claims, 2 Drawing Sheets

PACKAGING SYSTEM FOR PLASTIC BAGS

BACKGROUND OF THE INVENTION

Conventional thermoplastic bags formed of thin high strength plastic film come in many configurations and are usually provided in packs for the selective dispensing of individual bags at store checkout counters, adjacent produce bins, and in other environs whereat goods are to be loaded.

The bags will normally be packaged in rolls or flat stacks with the bags in each instance being releasably joined for the selective severance of single bags at the time of use. The roll is considered a particularly advantageous form of bag package for several reasons, including the accommodation of large number of bags in a compact package, the provision of a package which is easily stored and handled, and the provision of a package from which the individual bags can be conveniently and expeditiously removed for use. It is also significant that a roll package can be conveniently produced by merely rolling bags as they are formed along a continuous length of material.

The thermoplastic film bags themselves come in several forms, the two most popular forms comprising bags with plain or flat tops, frequently found at produce counters for the packaging and weighing of individual fruits, vegetables and the like; and T-shirt or handle bags, normally found at checkout counters for the accommodation of a variety of goods for subsequent transport from the store.

While the plain top bags conventionally come in rolls, and normally merely mount on spindles at the point of use, it has been the more common practice to supply the T-shirt or handle bags in flat bag packs wherein the bags are releasably welded together at central tabs integrally formed along the bag mouths between the side handles. The prior art has many examples of such bags, two of which will be noted in the Kuklies et al, U.S. Pat. No. 4,165,832, and Pilon, U.S. Pat. No. 4,529,090, wherein the central tabs not only provide means for the securement of the bags to each other, but also incorporate apertures for the mounting of the bag pack itself on a distribution rack or the like.

Although the flat bag pack has been found to be an adequate means for supplying T-shirt bags, the provision of such bags in rolls would be preferred both for the reasons set forth previously, and in light of the elimination of the multiple steps involved in forming the tabs with apertures therein, stacking the bags and securing the bags, normally by a heat sealing of the tabs to each other. Also, providing such bags in rolls would be a logical following step in the sequential forming of such bags from continuous tubular lengths of thermoplastic film.

However, practical difficulties arise when T-shirt bags are packaged in a roll, particularly wherein, for an effective dispensing of the bags with the closed ends of the bags outermost, it is necessary that the bags be rolled with the top or handle end of the bag fed forwardly into the roll.

For example, in following what appears to be a simple procedure of forming severably joined T-shirt bags from a continuous tubular film, a significant problem arises in that as the tubular film moves in a longitudinal direction toward the receiving roll, air enters into the leading mouths of the bags causing a ballooning or outward billowing of the bag sheets. This in turn causes a significant disruption in the smooth longitudinal extent of the continuous strip of bags as well as considerable wrinkling of the bag sheets as the bags are compressed at the point of rolling and the air forced therefrom. As can be appreciated, the air inflation and pressure deflation of the bags could also result in weakening or damaging of the individual bags or the joinders therebetween. While it is conceivable this problem could be avoided by rolling the bags with the closed bottom ends thereof leading onto the roll, this would not be a satisfactory solution for situations wherein the bags are manually separated in light of the awkward manipulation of the bags which would be required.

In light of the foregoing, while the desirability of rolled packages has been known, the adaptability of such rolled packages to handle or T-shirt bags with the open mouths of the bags directed toward the roll during formation of the package has not heretofore resulted in a particularly acceptable package.

SUMMARY OF THE INVENTION

The present invention is specifically concerned with a means and method whereby T-shirt bags can be efficiently formed in a continuous strip of severable bags and forwardly moved as a continuous strip to and into a bag package, preferably a bag roll with the handle ends of the bags forwardly introduced into the package or roll. In forming such a package, one object of the invention is to eliminate the multiple steps heretofore required in packaging T-shirt bags in stacks, including the necessity for defining mounting tabs with mounting apertures therethrough and severance lines between the tabs and the bag sheets, and the provision of means welding or otherwise securing the tabs to each other as the primary source of bag retention within the formed pack. It is also a significant object of the invention to eliminate the rather disruptive effects of ballooning or billowing of continuous strip bags and to thereby provide a package which is compact, attractive and retains the bags for dispensing without wrinkles, wall distortions, etc. as might interfere with use of the individual bags.

Basically, the system of the present invention requires only a modification of the mouth and handle forming die cutter to provide elongate central lips along the leading edges of the two sheets which define each bag mouth. These lips are integral forward extensions of the bag sheets and do not constitute mounting tabs, requiring no perforations, severance lines, heat welding or the like.

The sole function of the narrow elongate lips is to jointly flop over to one or the other sheet-defined faces of the bag to effectively close the mouth of the bag and preclude the entry of air thereto and any corresponding ballooning or outward billowing of the bag walls or side sheets. Thus, the bags retain their basic planar configuration throughout the length of forward feeding thereof both during the formation of the strip-joined individual bags and during the packaging thereof, normally into a roll of continuously joined bags. Because of the extremely thin nature of the film used, the folded-over lips will cause no noticeable surface disruption in the roll and will in no way interfer with the compact rolling of bags on each other.

In this manner the invention uniquely combines the most practical bag configuration with the most practical packaging system to provide a particularly acceptable package.

Additional objects and advantages of the invention may become apparent from the details of structure and construction more fully hereinafter described and claimed.

DESCRIPTION OF PREFERRED EMBODIMENT

Figures 1, 2, 3:
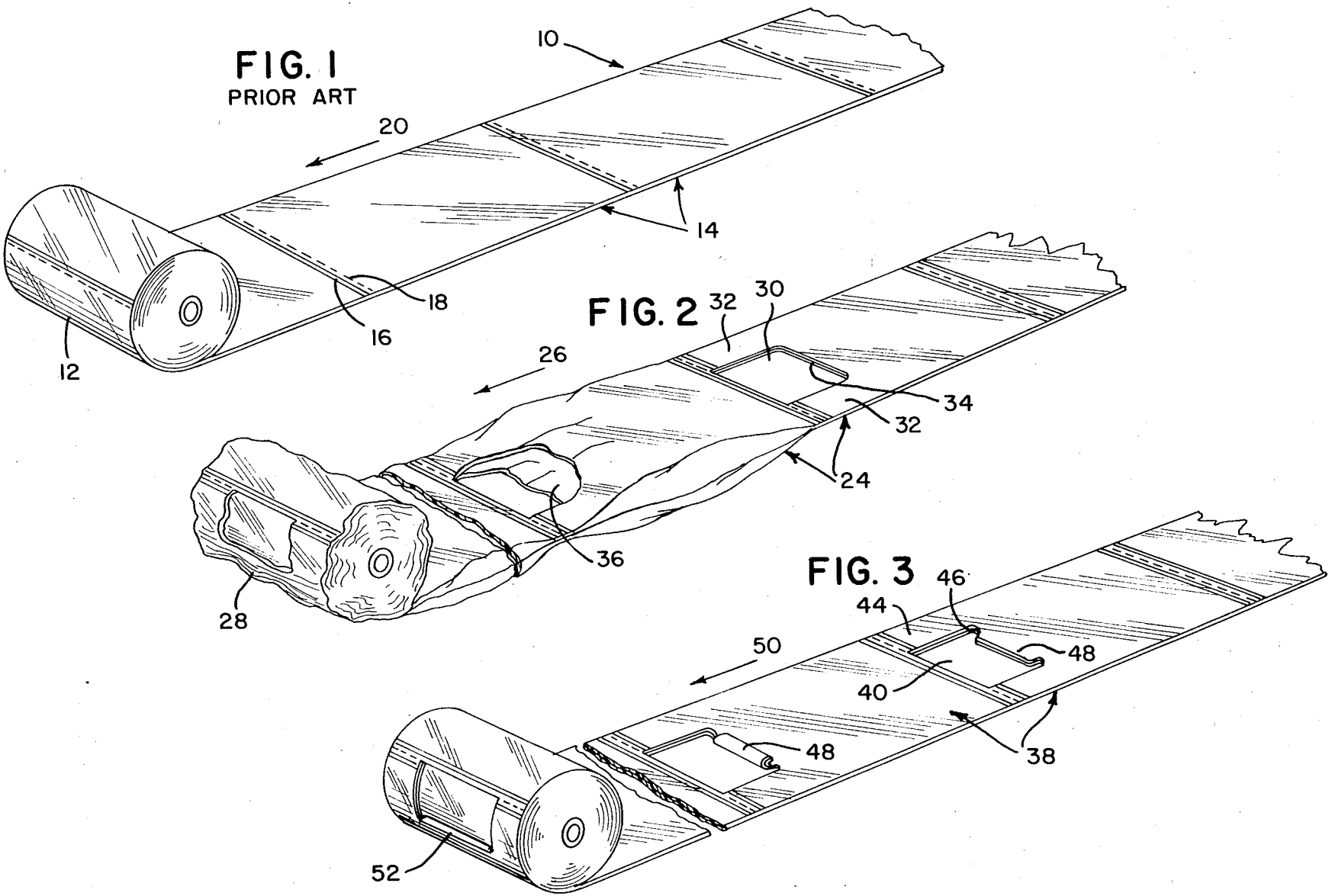
FIG. 1 PRIOR ART
FIG. 1 is an illustration of roll packaging of plain-top bags.
FIG. 2 is a perspective illustration of forwardly moving strip-joined T-shirt bags with a straight mouth and the resultant ballooning arising therefrom.
FIG. 3 is a perspective illustration of forwardly moving strip-joined T-shirt bags formed in accord with the present invention.

Referring now more specifically to the drawings, FIG. 1 illustrates a strip 10 and and roll 12 of severable bags 14 of the most basic type normally packaged in rolls. In defining the bags 14, the strip 10 is provided with transverse seal lines 16 and, adjacent thereto, transverse severance lines 18. The seal lines weld the two sheets of the tubular film together to form a bag bottom. The severance lines 18 are provided through both of the sheets to define the open mouth of the bag upon severance from the strip. Inasmuch as the bag mouths are closed until such time as the individual bags 14 are severed from the strip 10 immediately prior to use, the strip, moving in the direction of arrow 20, can be conveniently rolled into the roll package 12 at high speed and with no bag distortion. Such bags are most frequently found at produce counters for the separate packaging of produce.

As a roll package constitutes the most efficient and convenient package for film bags, attempts have made to similarly package T-shirt or handle bags. However, substantial problems arise in connection with the provision such rolls wherein the bags are continuously fed into the roll with the handles and open mouth forwardmost. FIG. 2 schematically illustrates a strip 22 of T-shirt bags 24 being fed in a forward direction, indicated by arrow 26, toward a packaging roll 28 or the like.

In the proposed packaging system of FIG. 2 wherein the bags are to be retained in strip form until severed for individual use, the handles or T-shirt configuration are defined by a basic U-shaped cutout 30 forming a pair of laterally spaced forwardly extending handles 32 with a transverse straight-edge bag mouth 34 between the inner ends of the formed handles 32, all as illustrated in the rearmost complete bag in the strip 22 of FIG. 2.

However, when formed in the above described manner, it was found that upon a forward feeding of the strip of bags with defined bag handles and mouth, the individual open-mouth bags would fill with air, causing an outward billowing or ballooning of the bags, as suggested at 36 in the forwardmost complete bag in FIG. 2. This unexpected result seriously affected the smooth continuous conveying of the strip-joined bags, particularly in situations wherein elongate strips are involved with multiple bags individually ballooning therealong. This ballooning also had a particularly detrimental effect on attempts to form a compact package of the strip bags because of the misorientation, wrinkling and distortion of the overlying sheets as the strip moved into a package configuration, preferably a roll although also conceivably a fan-folded stack of the continuous strip bags.

While it is appreciated the problem could be eliminated by forwardly feeding the bags onto the roll with the closed bottoms of the bags forwardmost, this would result in unnecessary difficulties and cumbersome manipulation of the bags as they are severed from the roll and mounted on a support rack for loading. With such an orientation, the individual bags would have to be severed by gripping the bottom of the leading bag, severing it from the next adjacent bag, and then inverting the bag for opening and mounting. Accordingly, in order for the bag pack to be a practical substitute for conventional stacked bag packs in a commercial operation such as the checkout counter of a grocery store, it is essential that the bags are withdrawn from the package or roll with the bottom edge first whereby the checker can grasp the leading bag at the handle end immediately adjacent the line of severance, apply direct pressure thereto, severing the handles from the following bag, and immediately and directly mount the handles to a support rack for bag loading.

The present invention proposes a particularly unique solution to the problem of bag ballooning. Noting FIG. 3, the handle bags 38 of the bag strip 40 have modified U-shaped cutouts 42 forming the laterally opposed pairs of handles 44, and also forming transverse bag mouths 46 which include central forwardly extending elongate overlying pairs of lips 48 on the overlying sheets which define the individual bags. These lips 48, noting the forwardmost complete bag in the direction of travel 50, will, as a pair and upon encountering a relative air flow resulting from the rapid forward movement of the strip 40 of bags 38, curl rearwardly into overlying relationship onto one or the other of the sheets defining the individual bags. This in turn results in an effective sealing of the mouth of the bag against air flow thereinto. Simultaneously, the overlying lips will tend to compress the sheets together, further precluding air entry and effectively avoiding the problem of bag billowing or ballooning. In the absence of any such disorientation of the bags 38 of the strip 40, the resultant roll or package 52 will be compact, smooth, presentable in appearance, and in every manner an acceptable package.

The extremely thin nature of the film material used in forming the bag will enable a folding of the lips to close the bag mouths without causing any discernable bump or disruption in the surface of the roll, even in rolls accommodating several hundred bags as contemplated. As a practical matter, inasmuch as the handle bags will normally incorporate full height side gussets, providing extra folds of material along the full longitudinal edges of the strip, the central folded lips, assuming they remain folded as the bag enters the roll, will not even be noted in the roll package between the slightly firmer edges thereof defined by the gusset folds.

The lips 48 are to be of a substantial length relative to the transverse length of the bag mouth, for example two-thirds or more of the transverse length of the mouth and centrally located therealong. The height of the lips 48 need only be such as to insure a proper folding or flapping over of the lips as a pair to one side or the other of the bag mouth. A height of $\frac{1}{2}$ inch to $\frac{3}{4}$ inch has been found to be effective for a wide range of bag sizes.

Figure 4:
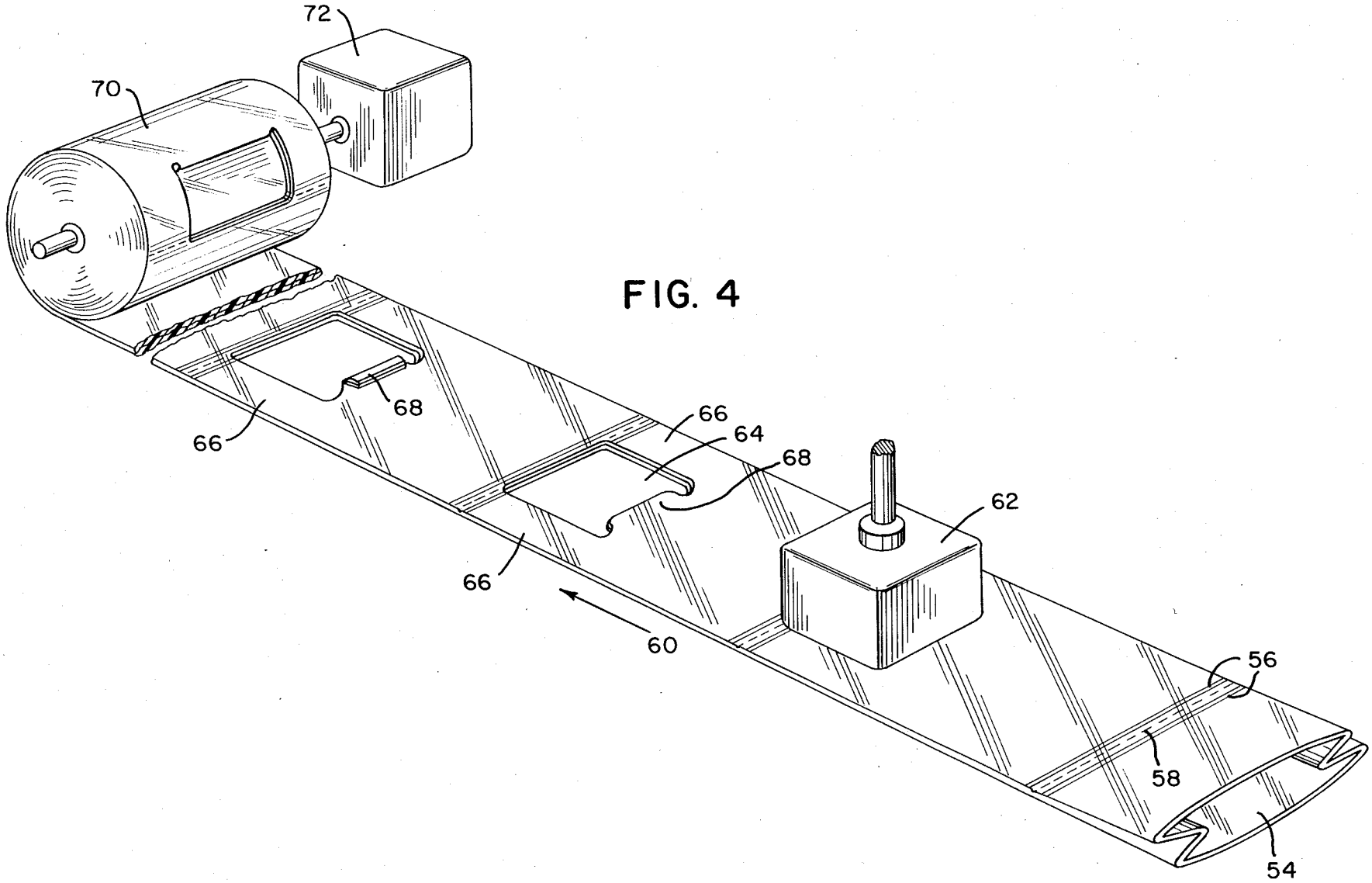
FIG. 4 is a schematic illustration of the formation and rolling of bags in accord with the present invention.

FIG. 4 schematically illustrates the sequence of steps in the bag package forming system of the invention.

Basically, a continuous tubular length 54 of plastic film is supplied and defines a pair of edge-joined overlying sheets which are forwardly fed through appropriate apparatus which initially seals the overlying sheets together along closely adjacent transverse seal lines 56 with a line of severance 58, for example perforations, extending centrally between and parallel to the lines 56. The seal lines 56, for example formed by a heat sealing of the thermoplastic material of the bag strip, define respectively the closed bottom of a forward bag and the closed top of a following bag in the packaging direction 60. At another station, appropriate die cutting apparatus 62 forms, in a single cut, the cutout 64 which simultaneously defines the laterally opposed handles 66 and the transverse bag mouth with the forwardly projecting mouth lips 68. As will be recognized, the cutout 64 extends rearwardly from the forward severance line 58 whereby a severance of a bag from the strip requires only a severing of the outer ends of the formed handles 66.

As the strip of bags moves toward the packaging roll 70, possibly driven by appropriate motor means 72 and constituting the means forwardly drawing the strip during the formative stages thereof, the lips 68 will flap or fold to one side of the associated bags, effectively closing the mouths thereof and precluding the entry of air and the disruptive ballooning of the bags. Each pair of lips 68 will, bacause of the nature of the material and the opposed free ends thereof, always fold as a pair to a single side of the bag. The final result is a completely acceptable package of severably joined T-shirt or handle bags which is readily mountable in any conventional manner for proper dispensing of the individual bags both expeditiously and conveniently as required at checkout counters and the like where convenience and speed is desired if not essential.

It is to be appreciated that while the height of the lips is sufficient to close the bag mouths, the lips do not interfer with the opening of the mouths of the individual bags for loading purposes, and similarly do not interfere with either the introduction of goods thereto or the removal of goods therefrom.

I claim:

1. In a forming system for packaging a strip of severably joined T-shirt bags of plastic film in a bag package, a continuous length of formed bags defined by edge-joined overlying sheets of plastic film, means for longitudinally feeding said length of formed bags in a forward direction toward a bag package being formed, said length of formed bags having transverse severance lines thereacross at longitudinally spaced positions therealong and defining individual bags between adjacent pairs of severance lines, each of said bags having a leading top end defined by a forwardmost one of the pair of severance lines defining the bag, each bag having a central cutout along the leading end thereof, said cutouts defining a pair of laterally spaced bag handles extending rearwardly from the leading end of each bag and a transverse bag mouth between said handles in rearwardly spaced relation to the leading end of each bag, each bag mouth being defined by free overlying edges of the overlying sheets, said free overlying edges of each bag including means for precluding entry of air into the bag mouth upon forward feeding of said bags.

2. The bag package forming system of claim 1 wherein said means for precluding entry of air comprising central lips formed as forwardly extending integral continuations of said sheets, said lips having opposed ends laterally inward of the corresponding laterally spaced bag handles for a free rearward folding of the lips and a closing of the bag mouths in response to relative air flow over the bag mouths upon a forward feeding of the length of formed bags to preclude admission of air between and separation of the overlying sheets.

3. The bag package forming system of claim 2 wherein said lips extend along a major portion of the length of the corresponding mouth-defining edges.

4. The bag package forming system of claim 3 wherein said bag package is a roll of joined bags.

5. The bag package forming system of claim 2 wherein said bag package is a roll of joined bags.

6. For use in a bag package forming system for packaging a strip of severably joined T-shirt bags of plastic film, a continuous length of formed bags defined by edge-joined overlying sheets of plastic film, said length of formed bags having transverse severance lines thereacross at longitudinally spaced positions therealong and defining individual bags between adjacent pairs of severance lines, each of said bags having a leading top end defined by one of the pair of severance lines defining the bag, each bag having a central cutout along the leading end thereof, said cutouts defining a pair of laterally spaced bag handles extending rearwardly from the leading end of each bag and a transverse bag mouth between said handles in rearwardly spaced relation to the leading end of each bag, each bag mouth being defined by free overlying edges of the overlying sheets, said free overlying edges of each bag including central lips comprising forwardly extending integral continuations of said sheets, said lips having opposed ends laterally inward of the corresponding laterally spaced bag handles for a free rearward folding of the lips and a closing of the bag mouths in response to relative air flow over the bag mouths upon a feeding of the length of formed bags with the leading ends forwardmost to preclude admission of air between and separation of the overlying sheets.

7. The length of formed bags of claim 6 wherein said lips extend along a major portion of the length of the corresponding mouth-defining edges.

8. A method forming a bag package of a continuous strip of severably joined T-shirt bags comprising the steps of providing a continuous length of coextensive overlying sheets of plastic film, moving said length in a forward longitudinal direction, defining a series of severably joined bags along said length with leading ends of said bags forwardmost, providing a cutout through both sheets centrally of and inward from the leading end of each bag to form a pair of forwardly directed laterally spaced bag handles with a transverse bag mouth therebetween and with forwardly directed lips, one integral with each sheet, centrally of the bag mouth, maintaining the severable joinder between the bags, forwardly moving the joined bags with the handles and bag mouths forwardly directed toward and into a bag package, relative air flow generated by forward movement of the joined bags producing a folding of the lips rearward over the respective bag mouths to preclude air flow into said bags.

* * * * *